US005490487A

United States Patent [19]

Kato et al.

[11] Patent Number: 5,490,487

[45] Date of Patent: Feb. 13, 1996

[54] THROTTLE VALVE CONTROL DEVICE

[75] Inventors: Hideki Kato, Toyohashi; Tosio Matsuzawa, Toyota; Touru Shimizu, Nishikasugai; Tetsuji Yamanaka; Yoshiyuki Kouno, both of Kariya, all of Japan

[73] Assignee: Nippondenso Co., Ltd, Kariya, Japan

[21] Appl. No.: 415,518

[22] Filed: Apr. 3, 1995

[30] Foreign Application Priority Data

Apr. 4, 1994 [JP] Japan ..... 6-066150
Oct. 12, 1994 [JP] Japan ..... 6-246329

[51] Int. Cl.[6] ..... F02D 7/00

[52] U.S. Cl. ..... 123/399

[58] Field of Search ..... 123/399, 360, 123/361, 397, 398, 337, 305

[56] References Cited

U.S. PATENT DOCUMENTS

| | | | |
|---|---|---|---|
| 4,879,657 | 11/1989 | Tamura et al. | 364/431.07 |
| 5,018,496 | 5/1991 | Buchl | 123/399 |
| 5,092,296 | 3/1992 | Gunter et al. | 123/337 |
| 5,201,291 | 4/1993 | Katoh et al. | 123/399 |
| 5,297,522 | 3/1994 | Buchi | 123/399 |
| 5,301,646 | 4/1994 | Doi et al. | 123/399 |
| 5,341,141 | 7/1995 | Kanazawa et al. | 123/399 |
| 5,423,299 | 6/1995 | Kumagai | 123/399 |

FOREIGN PATENT DOCUMENTS

| | | | |
|---|---|---|---|
| 6-33804 | 2/1994 | Japan | 123/399 |

*Primary Examiner*—Raymond A. Nelli
*Attorney, Agent, or Firm*—Cushman, Darby & Cushman

[57] ABSTRACT

A speed reduction gear including a semicircular control gear is provided coaxially with a motor shaft between a motor and a throttle valve. A connecting lever which has a valve opening contact and a valve closing contact is secured to a shaft of the throttle valve. When the control gear turns in the valve closing direction, it engages with the valve closing contact, and the throttle valve is closed. A safety stopper and its actuator are also provided. When the control gear turns in the valve opening direction while the stopper is driven by the actuator to extend in the path of the control gear, the control gear is prevented from further turning in the valve opening direction. When a cruise control switch is turned on, the stopper is retracted by the actuator from the passage and the gear turns in the valve opening direction until it abuts the valve opening contact of the connecting lever, which opens the throttle valve. As a result, the throttle valve is prevented from opening excessively when the electric control system fails and the throttle valve may be controlled in both directions by the motor.

17 Claims, 11 Drawing Sheets

THROTTLE VALVE CONTROL DEVICE

CROSS REFERENCE TO RELATED APPLICATIONS

The present application is based on and claims priority from Japanese Patent Application No. Hei 6-66150 filed on Apr. 4, 1994 and Japanese Patent Application No. Hei 6-246329 filed on Oct. 12, 1994, the contents of which are incorporated herein by reference.

BACKGROUND OF THE INVENTION

1. Field of the Invention

The present invention relates to an engine throttle valve control device for a vehicle.

2. Description of the Related Art

In a conventional engine throttle valve control device for a vehicle a throttle opening angle controlled by an electronic control system is set to one which is optimal running speed of a vehicle in the cruise control mode or driving the ordinary running of a vehicle, as is exemplified by the device shown in FIGS. 17 and 18.

In those Figures, a throttle valve 101 is secured to a throttle shaft 102 which is rotatably supported by a throttle body 103. An end of the throttle shaft 102 adjacent to an accelerator pedal 108 is engageable with an accelerator upper limit lever 106. The throttle shaft 102 is biased by springs 104 and 105 in a direction which opens the throttle valve 101 (hereinafter referred to as the valve opening direction). The accelerator upper limit lever 106 is biased by a spring 107 in the direction which closes the throttle valve 101 (hereinafter referred to as the valve closing direction). The other end of the throttle shaft 102 which is adjacent to a motor 120 is arranged to abut a motor-side guard 121 when it moves in the valve opening direction. The motor-side guard 121 is biased by a spring 122 in the valve opening direction.

During the normal operation of a vehicle, the accelerator upper limit lever 106 opens or closes according to the degree of pedal operation, and the throttle valve 101 opens or closes according to the operation of the accelerator upper limit lever 106. The valve position corresponding to the throttle valve open angle (hereinafter referred to as the open angle) of the motor-side guard 121 is controlled based on signals from a throttle valve position sensor 131 and an accelerator position sensor 132. The motor-side guard 121 causes the throttle valve 101 when moving in the valve closing direction.

During the cruise control, a diaphragm in a diaphragm actuator 110 is pulled by a vacuum pressure to move the accelerator upper limit lever 106 to the maximum valve opening position as shown in FIG. 18. The motor-side guard 121 is driven by the motor 120 and causes the throttle valve 101 in the valve closing direction in the same manner as in normal operation.

In the conventional throttle valve control device as described above, however, when the cruise control is initiated, the accelerator upper limit lever 106 is driven by the diaphragm actuator 110 in the valve opening direction against the biasing force of the spring 107, and therefore a large-sized diaphragm actuator 110 is required to generate a sufficiently strong driving force. Further, since the accelerator upper limit lever 106 is at its full extent of movement, when the driver operates the accelerator pedal 108 to further increase the vehicle speed, the pedal operation must be detected by the valve sensor 131 and the accelerator sensor 132, thereby resulting in complicated processing and increased response time.

There is another conventional throttle valve control device disclosed in U.S. Pat. No. 5,092,296. In that device, a motor driving force is transmitted to the throttle valve through an electromagnetic clutch which is disposed coaxially with the throttle shaft. The device has a reduction gear mechanism to reduce the rotational speed at a certain gear ratio and, therefore, an increased rotational torque is transmitted to the throttle shaft. As a result, an increased electromagnetic force is required for transmitting the driving force, thereby increasing the size of the electromagnetic clutch.

Japanese Patent Application Laid Open No. Hei 6-833804 discloses another conventional throttle valve control device which has a relatively small electromagnetic clutch disposed coaxially with a motor shaft. In this device, it is necessary to provide a member to carry the clutch member rotatably on the motor shaft. This structure still increases the size of the electromagnetic clutch.

SUMMARY OF THE INVENTION

The present invention has been made to solve the above-stated problems and has a primary object of providing an improved compact throttle valve control device.

Another object of the present invention is to provide an improved throttle valve control device in which no actuator to drive an accelerator guard to the valve opening direction is necessary.

Still another object of the present invention is to provide a compact throttle valve control device which ensures stable throttle positioning not only during the idling operation but also during the normal operation of the engine.

A further object of the present invention is to provide a compact throttle valve control device which prevent throttle valve from opening excessively even when the electric control system breaks down.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENT

A first preferred embodiment according to the present invention will now be described with reference to the appended drawings.

A throttle valve control device according to a first embodiment of the present invention is described with reference to FIGS. 1 through 8. The throttle valve control device according to the present invention includes a foot-operated accelerator system and an electric operation system, and the foot operated accelerator system will be described first.

Figure 1:
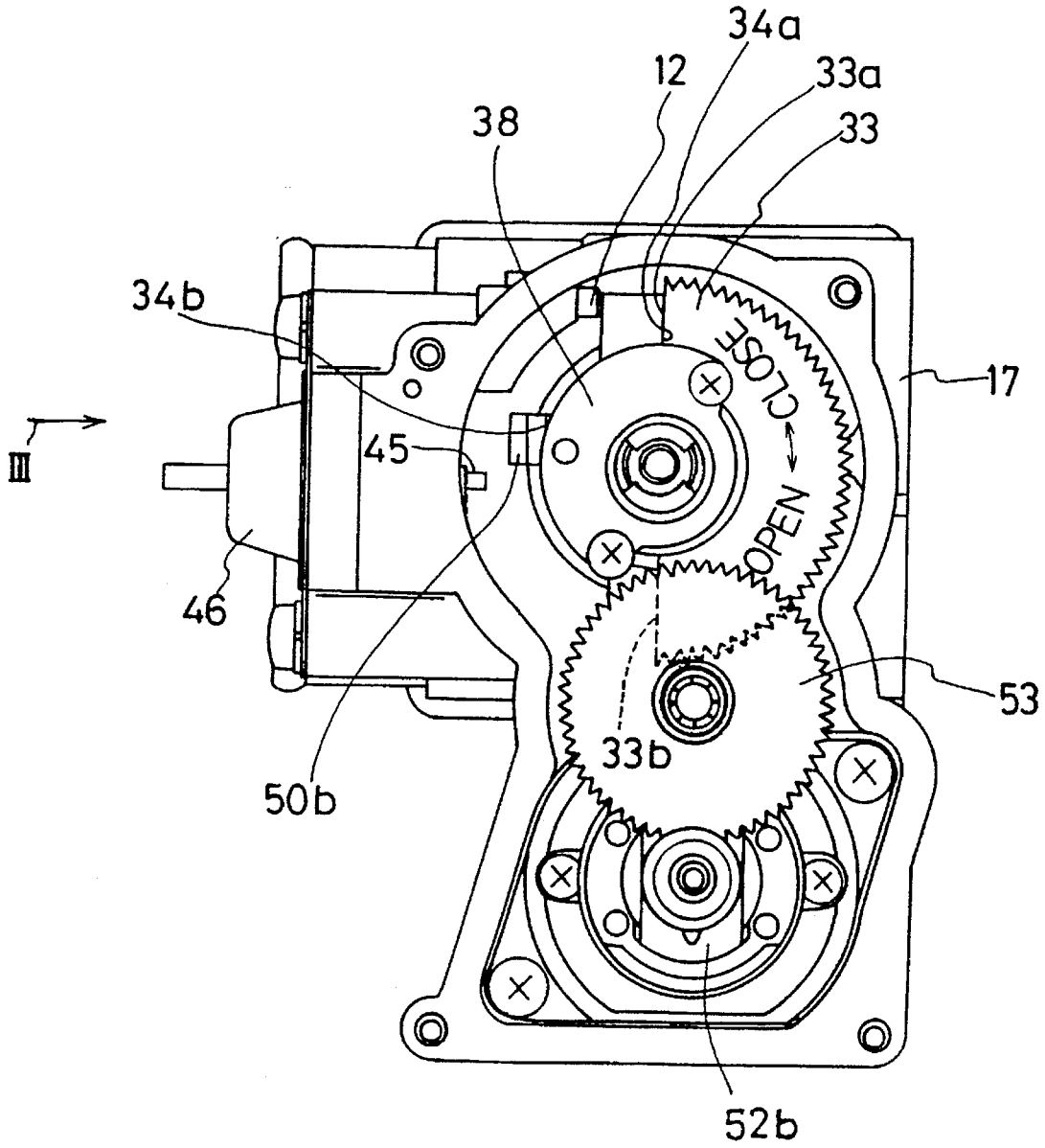
FIG. 1 is a cross-sectional front view illustrating a main portion of a throttle valve control device according to a first embodiment of the present invention.
Figure 2:
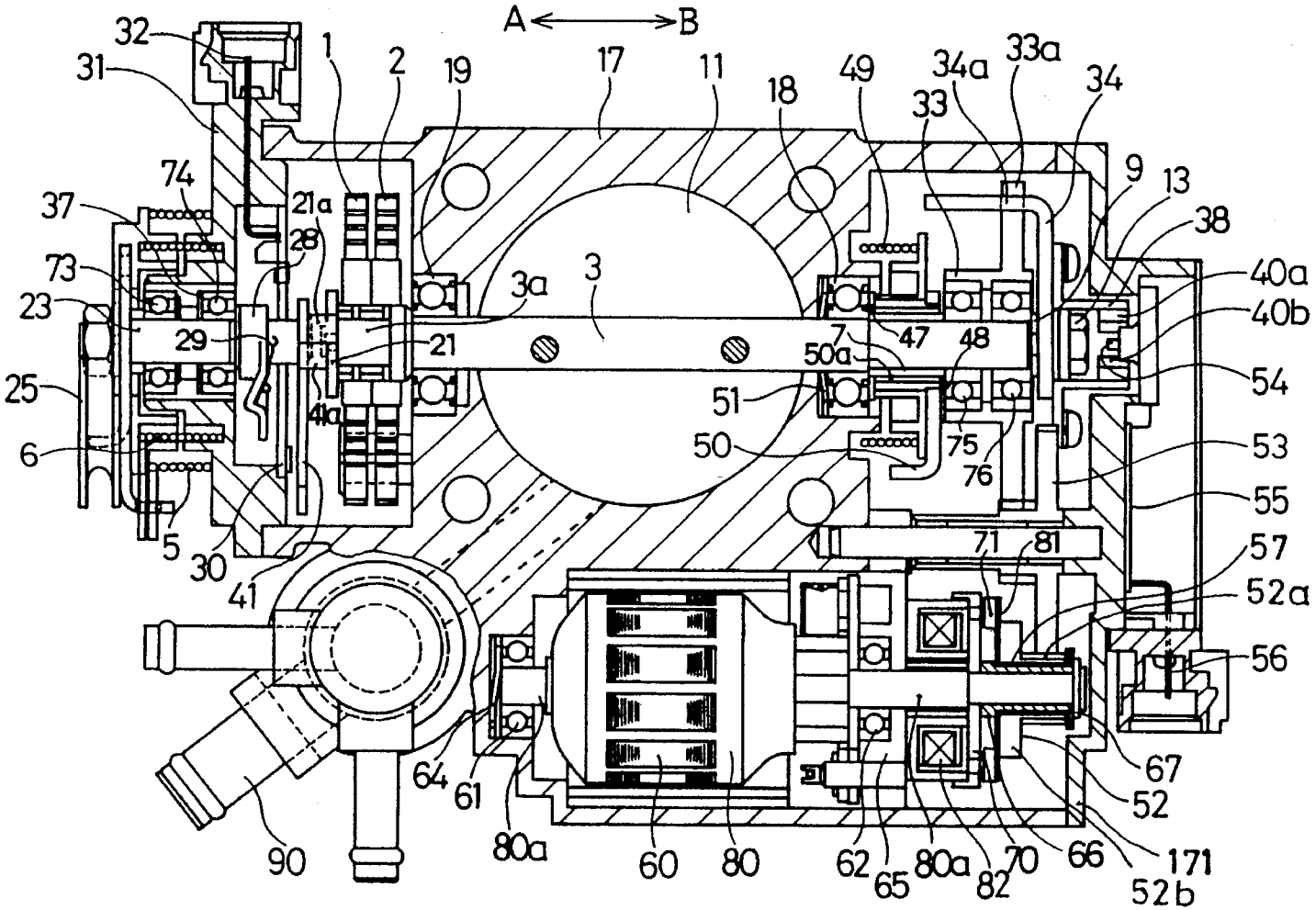
FIG. 2 is a cross-sectional side view of the device illustrated in FIG. 1.
Figure 3:
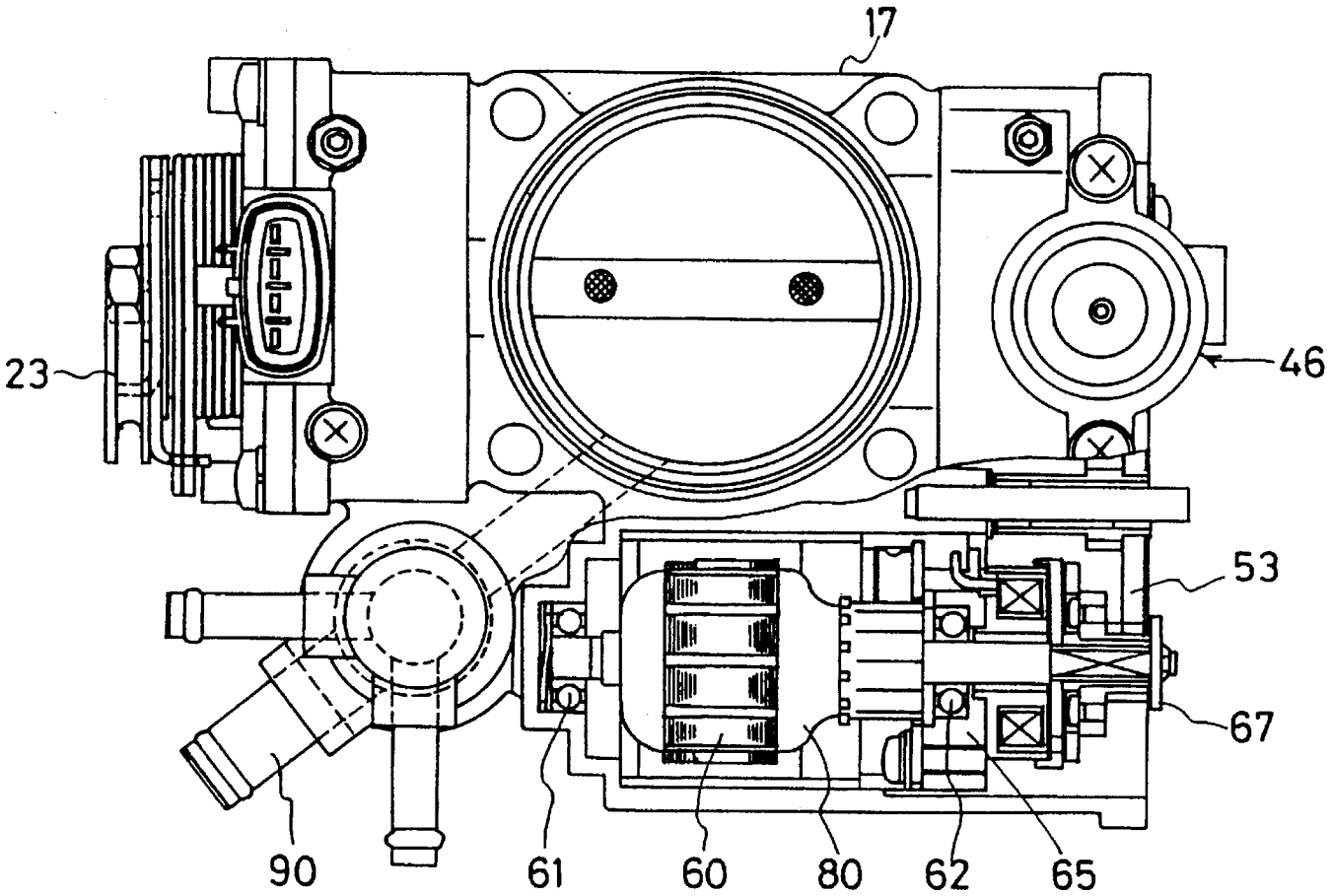
FIG. 3 is a cross-sectional view of the device illustrated in FIG. 1 viewed from a portion indicated by an arrow III.
Figure 4:
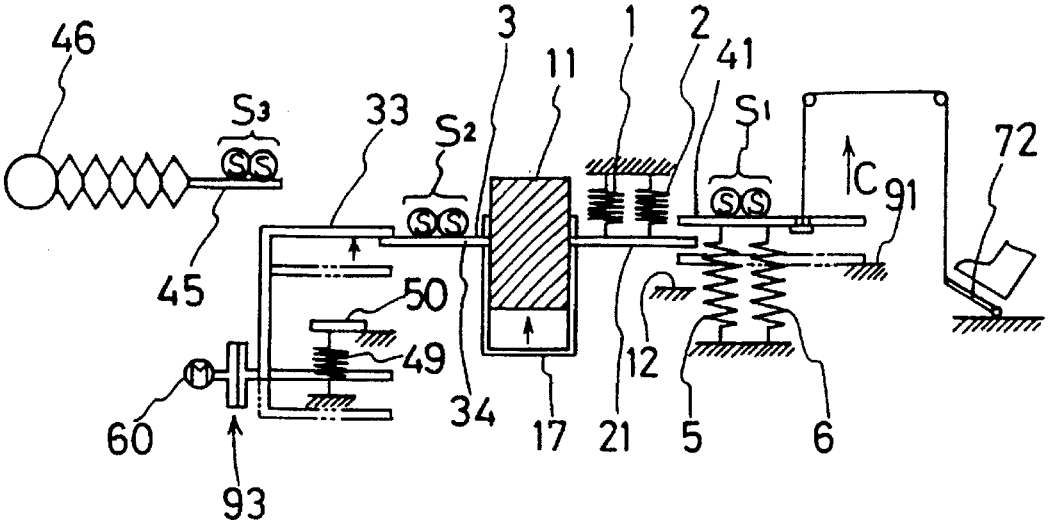
FIG. 4 is a schematic illustration of the operation of the device according to the first embodiment during the normal running of a vehicle.

As shown in FIG. 2, the foot operated acceleration system is composed of an accelerator shaft 23, an accelerator lever 25 which is press-fitted to an end of the accelerator shaft 23, an upper limit guard member 41 which is press-fitted to the other end of the shaft 23 and secured thereto by a nut or by squeezing the shaft 23, a throttle shaft 3, and a throttle lever 21 which is press-fitted to the throttle shaft 3. The throttle lever 21 engages the guard member 41 and a throttle valve 11. A driving force generated when a driver steps down on an accelerator pedal (not shown) is transmitted to the accelerator lever 25, the guard member 41, the throttle lever 21, the throttle shaft 3 to open the throttle valve 11.

The throttle shaft 3 is rotatably carried by bearings 18 and 19 which are supported by a throttle body 17. The throttle shaft 3 is retained in its axial direction in the following manner. The bearing 18 is loose-fitted to the throttle body 17 and a waved washer 51 is inserted between the bearing 18 and the throttle body 17 to bias an outer member of the bearing 18 in a direction indicated by an arrow B in FIG. 2; an inner member of the bearing 18 is fastened by a nut 13 at an end of the throttle shaft 3 through a collar 7, bearings 75 and 76, a control gear 33, a spacer 9 and a connecting lever 34; and an outer member of the bearing 19 abuts the throttle body 17 and an inner member of the bearing 19 abuts a step portion of the throttle shaft 3.

The throttle valve 11 is secured to the throttle shaft 3 and rotates together therewith. One end of each of springs 1 and 2 is fixed to a portion 3*a* proximate to the other end of the throttle shaft 3 and the other end of each of the springs 1 and 2 is connected to the throttle body 17. The springs 1 and 2 bias the throttle shaft 3 in a direction to open the valve 11 (the valve opening direction). The double springs ensure that the throttle valve is still biased to open in case either one of the springs breaks. The position of the throttle valve 11 being fully closed is regulated by a full-closing stopper 12 (not shown), which is described later.

The throttle lever 21 is press-fitted to the end portion 3*a* of the throttle shaft 3 and rotates together with the throttle shaft 3. The throttle lever 21 has a bent lever portion 21*a*, which is disposed to engage with a bent guard portion 41*a* of the guard member 41. The accelerator shaft 23 is rotatably carried by bearings 73 and 74, which are fitted to a housing 31. Springs 5 and 6 bias the accelerator shaft 23 in a direction to close the throttle valve 11 (the valve closing direction). The aggregate biasing force of the spring 5 and 6 is greater than the aggregate biasing force of the springs 1 and 2. The double springs ensure that biasing force applied to the accelerator shaft 23 to close it even if one of the springs breaks down.

A rotor 28 formed from a resinous material has a contact member 29 and is carried on the accelerator shaft 23. The contact member 29 is in contact with a sensor board 30. A resistor, or a potentiometer which generates an output signal according to a degree of turning of the contact member 29, is printed on the sensor board 30, so that the turning degree or turning angle at the accelerator lever 25 is detected as an electrical signal of a connector 32. Since the axial displacement (indicated by arrows A and B in FIG. 2) of the accelerator shaft 23 is restricted by the biasing force of the waved washer 37, contact between the contact member 29 and the sensor board 30 is ensured even engine vibration condition. An end of the accelerator lever 25 is press-fitted to an end of the accelerator shaft 23, and the other end of the lever 25 is connected to the accelerator pedal by a wire or a link (not shown). The accelerator lever 25 abuts the full-close stopper (not shown) at the closing side. The open angle of the accelerator full-close stopper is arranged to be greater than the open angle of the valve full-close stopper 12. The accelerator upper limit guard member 41 is secured to the accelerator shaft 23 by press-fitting, fastening with a nut, squeezing or welding, etc. Since the guard bent portion 41*a* abuts the lever bent portion 21*a*, the throttle valve 11 may not be opened beyond the opening angle set by the upper limit guard member 41 under the biasing force of the double springs 1 and 2.

The electric operation system of the throttle valve control device of the first embodiment will be described next.

The aforementioned control gear 33 has a semicircular plate and is rotatably carried by bearings 75 and 76 disposed around the throttle shaft 3. When the control gear 33 turns counterclockwise in FIG. 1, the gear contact portion 33*a* abuts the lever contact portion 34*a* of the lever 34, and the throttle valve 11 is turned in the closing direction. When the control gear 33 turns in the valve opening direction, another contact portion 33*b* abuts a safety stopper 45, and the gear 33 cannot turn further in the valve opening direction. At this time, the gear 33 cannot drive the throttle valve 11 in the closing direction.

The connecting lever 34 is fixed to the throttle shaft 11 to rotate along with the shaft 11 as a unit. Another lever contact portion 34*b* is disposed on a portion of the shaft 11 at a prescribed angle to the lever contact portion 34*a*. The connecting lever 34 abuts a valve full-close stopper 12 formed on the throttle body 17 at the side to close the valve 11. As a result, the throttle valve cannot turn further in the valve closing direction. Since the safety stopper 45 is connected to a vacuum diaphragm actuator 46 so that it may be retracted when a vacuum pressure is applied, the control gear 33 can further turn in the valve opening direction further. At this moment, the gear contact portion 33*b* can be in contact with the lever contact portion 34*b*, and the control gear 33 can drive the throttle valve 11 to the opening direction. The safety stopper 45 has a position sensor equipped with an element such as a Hall-effect element (not shown) to detect the position of the safety stopper 45.

A safety lever 50 is rotatably carried by the collar 7 via a metal bearing 50*a* which is press-fitted into an inner periphery of an opening formed in the lever 50. Thus, the rotational friction between the collar 7 and the lever 50 is reduced. Nylon plates 47 and 48 are disposed on both sides of the safety lever 50 to reduce the rotational friction. The safety lever 50 is biased by a spring 49 in the valve closing direction. When the control gear turns beyond the stopper 45 to open the throttle valve 11, a contact portion 50*b* of the safety lever 50 abuts the gear contact portion 33*b*, and the gear 33 is biased back to the valve closing direction from the position of the safety stopper 45. The safety lever 50 is equipped with a full-close stopper (not shown) at a position corresponding to the position of the safety stopper 45 so that it sends the control gear 33 back to the valve closing direction only when the control gear 33 turns to the valve opening direction beyond the safety stopper 45.

A collar 38 is made of a soft magnetic material, and is secured to the connecting lever 34 by screws or the like. A pair of N pole and S pole magnets 40*a* and 40*b* are fixed to the inner surface of the collar 38 to form a magnetic circuit. A magnetic sensor 54 (shown in FIG. 2) is disposed between the magnets 40*a* and 40*b*, and detects the rotational angle or open angle of the throttle shaft 3 and send a position signal to a processing unit 55. The output signal of the processing unit 55 is transmitted through a connector 56 to a control unit (not shown) as a parameter indicating the control angle of the motor 60. Since the axial movement of the throttle shaft 3 is regulated, the magnetic sensor 54 detects the position without fluctuation.

The motor 60 is controlled by a control unit (not shown) to turn the throttle valve 11 through a prescribed angle. The motor 60 has a rotor 80 and a shaft 80*a* which is rotatably carried by a bearing 61 fixed to the throttle body 17, and a bearing 62 fixed to a stator block 65 of the motor 60. The stator block is made of aluminum to dissipate heat generated when a clutch coil is energized as described later. However, the block may be made of other material such as iron or resinous material when the potential temperature rise is not significant or detrimental to other components.

A throttle cover 171 is made of a resinous material and covers an open end of the motor 60 as shown in FIG. 2 (i.e., a side indicated by an arrow B). The bearings 61 and 62 have inner members press-fitted to the shaft 80*a*. The outer member of the bearing 62 is, however, fitted to the block 65 with some clearance, in other words, it is loose-fitted to the block 65. A waved washer 64 is disposed between the bearing 61 and the throttle body 17 and biases the bearing 61 in a direction indicated by the arrow B. Since the outer member of the bearing 62 abuts the block 65, the rotor cannot move in the axial direction. A hub 70 which functions as a clutch rotor is press-fitted to the right end of the motor shaft 80*a* and rotates as a unit with the motor shaft 80*a*. A collar 66 and a spacer 67 are fixed to the motor shaft 80*a* by squeezing the shaft 80*a*.

A motor gear 52 has a cylindrical toothed portion 52*a* and a flange portion 52*b*. The flange portion 52*b* is formed on an end of the toothed portion 52*a* and has a peripheral portion which is greater in diameter than the toothed portion 52*a*. The motor gear 52 is rotatably carried by a metal bearing 57 around the collar 66. A leaf spring 81 is connected to the flange portion 52 by rivets or the like on a surface thereof and has an armature made of a soft magnetic material secured to the other surface by rivets or the like, so that the armature 71 rotates along with the motor gear 52. The outer periphery of the leaf spring 81 is greater in the diameter than the flange 52 and biases the armature 71 in the direction indicated by the arrow B to retain it in place even under the engine vibration conditions.

A clutch coil 82 is disposed around the motor shaft 80*a* between the block 65 and the hub 70, and forms an electromagnetic clutch which includes the hub 70, the armature 71 and the leaf spring 81. When the clutch coil 82 is energized, the armature 71 is attracted by the magnetic force generated in the clutch coil 82 toward the hub 70 against the biasing force of the leaf spring 81 and engages firmly with the hub 70 to rotate as a unit therewith. Thus, the driving force of the motor 60 is transmitted to the hub 70, armature 71, the motor gear 52, a connecting gear 53, the control gear 33 and the connecting lever 34 to the throttle shaft 3, which rotates the throttle valve to open or close.

Since the driving force of the motor 60 is transmitted through the flange portion 52*b* to the toothed portion 52*a* of the motor gear 52, the outer diameter of the toothed portion 52*a* may be made smaller than the diameter of the electromagnetic clutch portion. Thus, the gear ratio of the motor gear 52 to the control gear 33 which transmits the motor driving force to the throttle shaft 3 may be set, for example, to 1:15. That is, a large reduction ratio may be obtained, and the driving force of the motor 60 is increased by the gears 52 and 33 and transmitted to the throttle shaft 3. As a result, a small sized motor may be used, and a small sized electromagnetic clutch including the clutch coil 82 may be used.

An air valve 90 is, for example, a thermo-wax-filled valve which controls the bypassing air according to the temperature of cooling water of an engine. Since the valve is well known in the art, a detailed description thereof is omitted.

Operations of the throttle valve control device according to the first embodiment is described below with reference to FIGS. 4 through 8. In these figures, a guard sensor unit S1 includes the rotor 28, the contact 29, the sensor board 30 and the connector 32; a valve sensor unit S2 includes the collar 38, the magnets 40*a* and 40*b*, the processing unit 55 and the connector 56; a stopper sensor unit S3 includes the position sensor equipped with a Hall-effect element, for example; the clutch 93 includes the hub 70 and the armature 71; and the full-close stopper 12 is schematically illustrated as if it abuts the throttle lever 21 for the sake of simplicity.

(1) Normal Operation

When an ignition switch (not shown) is turned on, the clutch 82 is energized and connects the motor 60 to the control gear 33. When a driver operates the accelerator pedal, the accelerator upper limit guard 41 opens as indicated by an arrow c in FIG. 4 and an open angle signal of the upper limit guard 41 is generated at the guard sensor unit S1. The signal is processed by a processing unit (not shown) to provide a rotation control signal for the motor 60. The rotation control signal is then compared to an output signal of the valve sensor unit S2 to control the motor 60.

(2) Idling Speed Control

Figure 5:
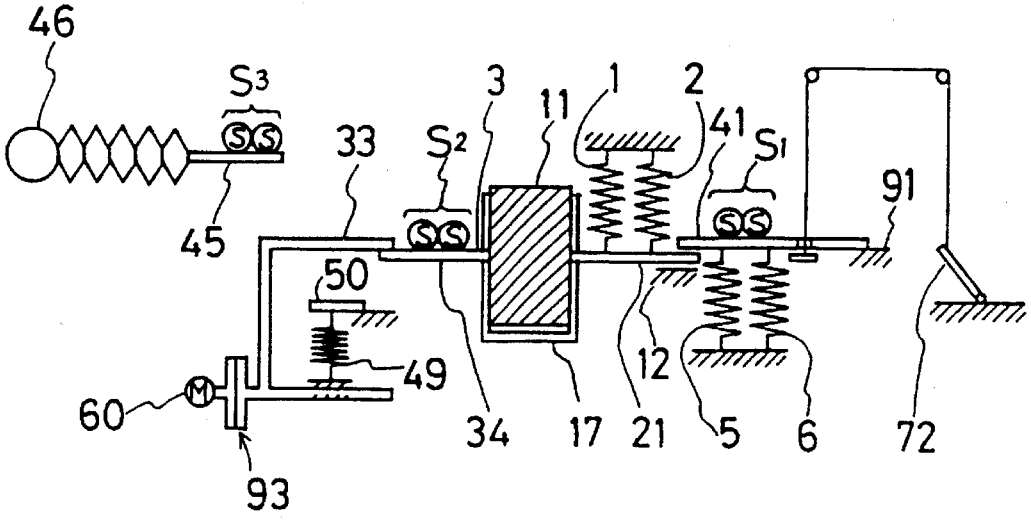
FIG. 5 is a schematic illustration of the operation of the device according to the first embodiment during the idling speed control of an engine.

When the engine runs at the idling speed, since the driver is not operating the accelerator pedal 72 as shown in FIG. 5 the accelerator upper limit guard 41 is positioned at the accelerator full-close stopper 12. The opening angle of the accelerator full-close stopper 91 is slightly greater than the angle of the valve full-close stopper 12. Therefore, the turning angle of the motor 60 is adjusted so that the throttle valve 11 is controlled between the valve full-close stopper 12 and the accelerator full-close stopper 91 and the idling speed is maintained at a prescribed speed. The air valve 90 prevents an excessive idling speed in case of break down of the motor 60 or the control unit (not shown). Ordinarily, there is about 30 $m^3/h$ difference in the air volume required for a cold engine running at the idling speed and a warmed-up engine running at the idling speed. Therefore, if the open angle of the accelerator full-open stopper 91 is set based on the air volume required for a cold start, the throttle valve 11 may open as widely as it opens at the accelerator full-open stopper 91 after engine is warmed up when that the motor 60 or the control unit breaks down. As a result, the engine may run at a high speed against the driver's wishes. In order to prevent the above problem, the air valve 90 is provided to supply increased air when required for cold engine idling and decreased air when required for the warmed-up engine idling.

(3) Cruise Control

Figure 6:
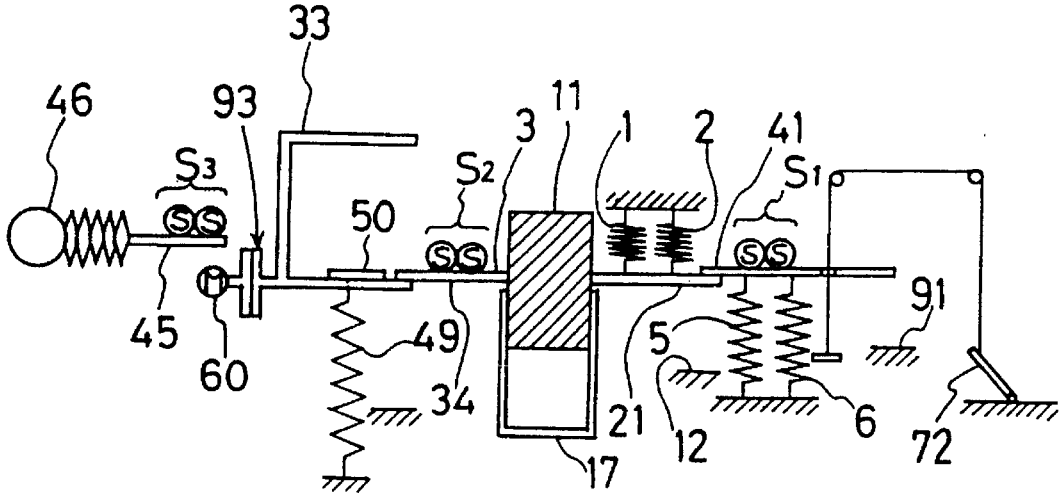
FIG. 6 is a schematic illustration of the operation of the device according to the first embodiment during cruise control of a vehicle.
Figure 7:
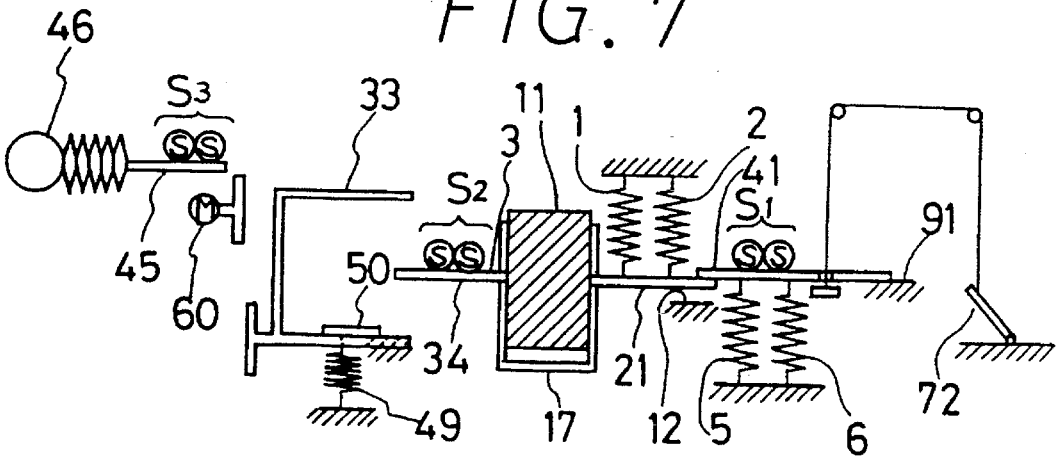
FIG. 7 is a schematic illustration of the operation of the device according to the first embodiment after cruise control is terminated.

When a driver turns on a cruise control switch (not shown) during ordinary operation of a vehicle, a vehicle speed when the switch is turned on is memorized by a processing unit (not shown), and a vacuum pressure is applied to the vacuum diaphragm actuator 46 to pull the safety stopper 45 therein as shown in FIG. 6. As a result, the motor 60 drives the control gear 33 to turn beyond the safety stopper 45 and open the throttle valve against the springs 5 and 6 while the accelerator pedal is left unoperated. Thus, the cruise control speed is controlled by the electric operation system. During the cruise control, since the throttle valve 11, the accelerator upper limit guard 41, the connecting lever 34 and the control gear 33 turn together, the difference in the output between the guard sensor S1 and the valve sensor S2 stays within a prescribed tolerance range.

When the driver steps on the accelerator pedal 72 during the cruise control, the open angle of the accelerator upper limit guard 41 becomes greater than the open angle of the throttle valve 11, and the difference in the output signals between the guard sensor unit S1 and the valve sensor unit S2 becomes greater than a threshold value. Thus, the operation of the accelerator pedal 72 is detected electrically, the clutch coil 82 is deenergized, and finally the cruise control is terminated. Of course, the cruising control may be also terminated by turning the cruise control switch off.

When the clutch coil is deenergized, the clutch 93 is disconnected and the driving force of the motor 60 is not transmitted to the control gear 33. Consequently, the throttle valve 11 is biased by the accelerator upper limit guard 41 back to the valve closing direction. When cruise control is terminated, the motor 60 turns the throttle valve 11 in the valve closing direction so that the throttle cannot remain in its open position even when the clutch is not disconnected by accident.

After cruise control has been terminated and the clutch 93 has been disconnected, the control gear 33 returns from the position of the safety stopper 45 in the valve closing direction by the safety lever 50 which is biased by the spring 49. Thereafter, when the vacuum diaphragm actuator 46 projects the safety stopper 45 and the stopper sensor S3 is thereby turned on, the clutch 93 is reconnected. Subsequently, the driving force of the motor 60 is transmitted to the control gear 33 and the throttle valve 11 is brought under control of the motor 60 again.

(4) Failure in Electric Control System

Figure 8:
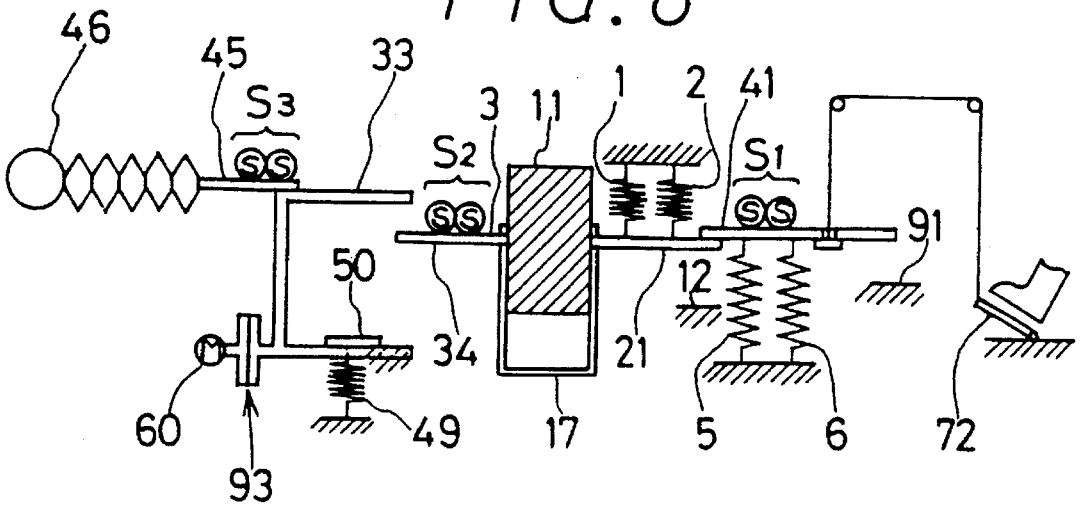
FIG. 8 is a schematic illustration of the operation of the device according to the first embodiment when the electronic control system fails.

In case the motor 60 abnormally turns further than a normal degree of the accelerator pedal position because of a failure in the processing unit or another portion of the electronic operation system, the control gear 33 engages with the safety stopper 45 as shown in FIG. 8, and it cannot turn the throttle valve 11 to open further. Since the open angle of the throttle valve 11 is limited by the accelerator upper limit guard 41, when the driver's foot is removed from the accelerator pedal, the throttle valve 11 turns to the valve closing direction.

In the throttle valve control device according to the first embodiment, the throttle valve is controlled by the motor in both the valve opening and closing directions, a device to open the upper limit guard 4 against the biasing force of the springs 5 and 6 (such as a vacuum actuator) is not necessary, and therefore the device may be made compact. Since the safety stopper 45 is provided, the throttle valve cannot open excessively even when the electric control system fails. Since the electromagnetic clutch is connected coaxially with the motor shaft 80*a* and the hub 70 (the clutch rotor) is fixed to the motor shaft 80*a*, the throttle valve control device is made compact.

Figure 9:
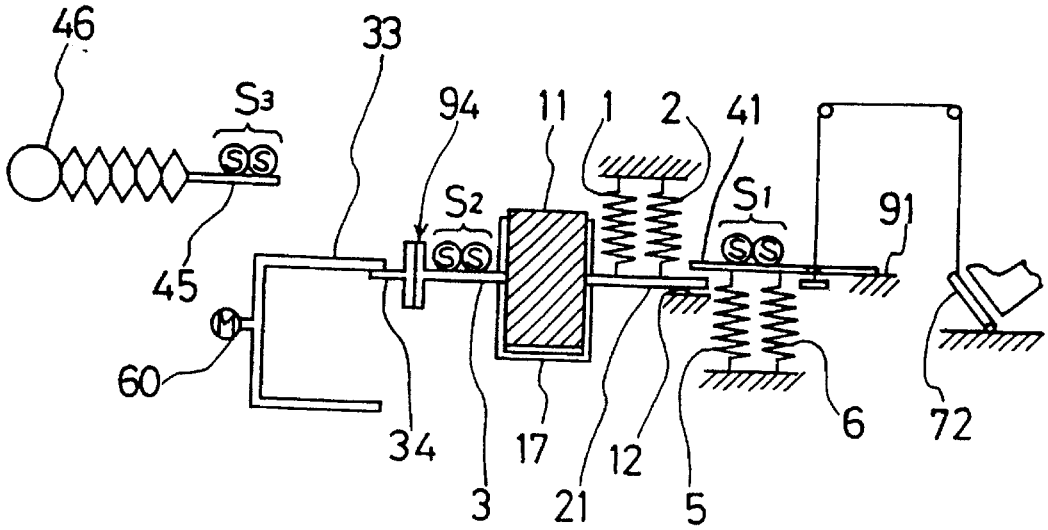
FIG. 9 is a schematic illustration of the operation of the device according to a second embodiment of the present invention.

A throttle valve control device according to a second embodiment of the present invention is described with reference to FIG. 9. The same reference numerals as in the other figures correspond to the same or similar portions or components and, therefore, detailed descriptions thereof are not made in the embodiments to follow hereafter except with regard to those portions of the device different from previously described embodiment.

A clutch 94 of this device is disposed between a connecting lever 34 and a throttle shaft 3. Members corresponding to the spring 49 and the safety lever 50 in the first embodiment do not exist in this embodiment. Therefore, an upper limit guard 41 returns a control gear 33 to the valve closing direction after the cruising control is terminated. Since the clutch 94 is not disposed in the motor 60, the size of the motor 60 is decreased.

Figure 10:
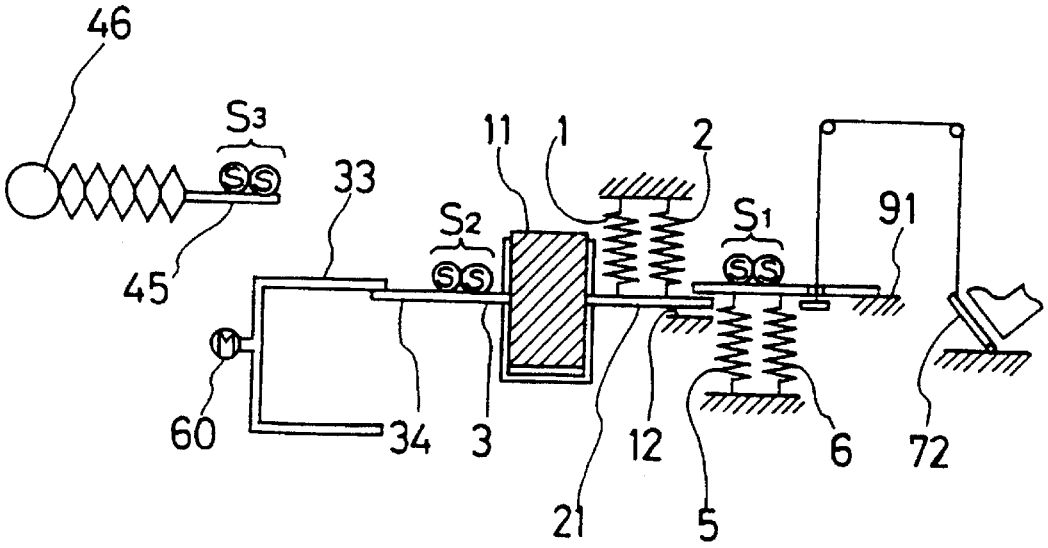
FIG. 10 is a schematic illustration of the operation of the device according to a third embodiment of the present invention.

A throttle valve control device according to a third embodiment of the present invention is described below with reference to FIG. 10.

The embodiment includes a device to control a motor to turn in the valve closing direction after cruise control is terminated and the clutch mechanism is may therefore omitted in this embodiment. Therefore, the size of the throttle valve control device is reduced further.

Figure 11:
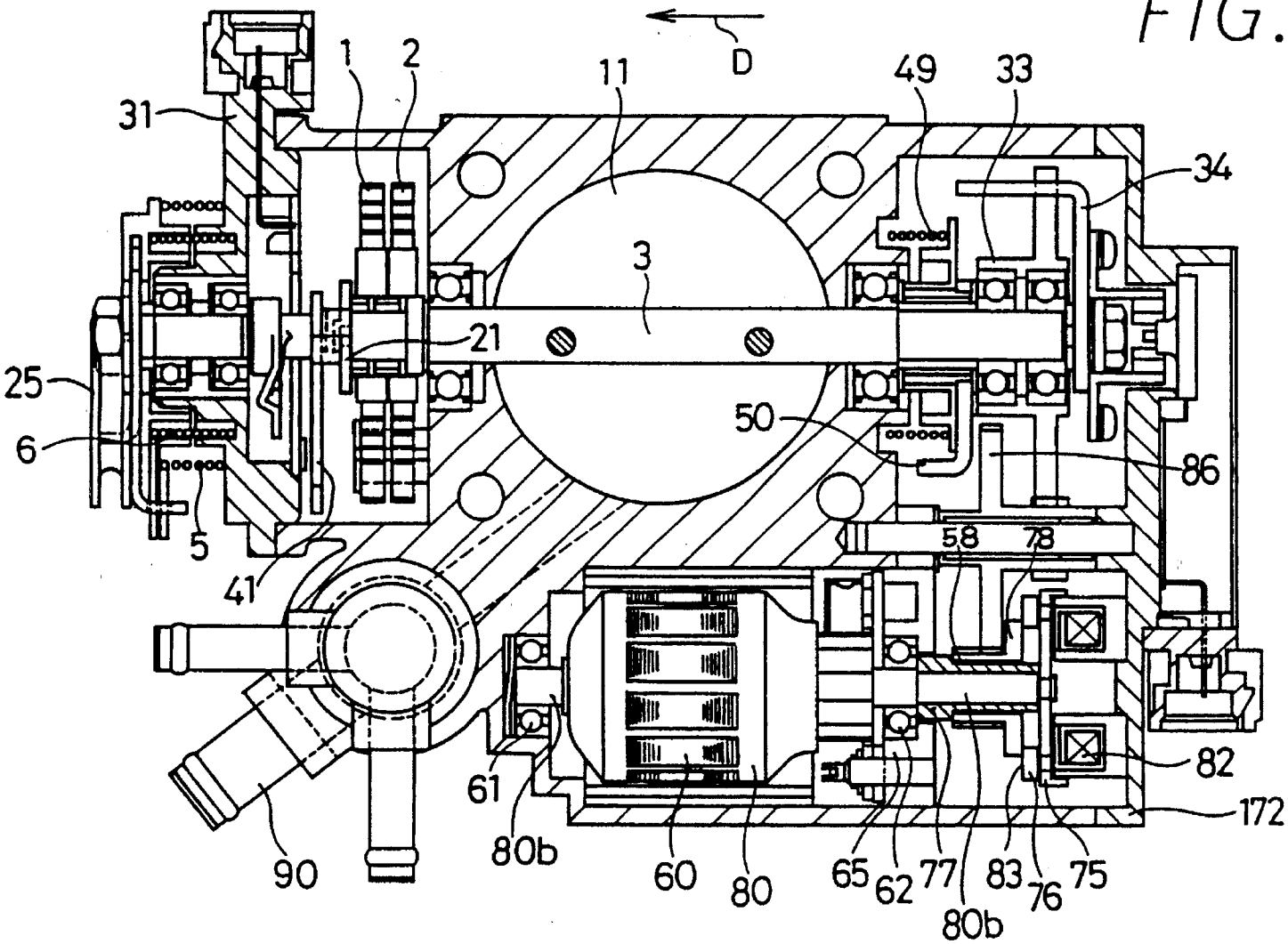
FIG. 11 is a cross-sectional side view illustrating a throttle valve control device according to a fourth embodiment of the present invention.

A throttle valve control device according to a fourth embodiment of the present invention is described below with reference to FIG. 11.

In this embodiment, since a motor shaft 80*b* and inner members of bearings 61 and 62 are press-fitted to one another, they rotate together. A hub 75 as a clutch rotor is press-fitted to the right end of the motor shaft 80*b* and a collar 77 is press-fitted to the motor shaft 80*b* between a step portion of the motor shaft 80*b* and the hub 75 so that the hub rotates together with the motor shaft 80*b*. A motor gear 78 has a metal bearing 58 press-fitted into its inner periphery and is rotatably carried by the collar 77. The motor gear 78 is fixed to a surface of a leaf spring 83 by rivets or the like and an armature 76 made of a soft magnetic material is also fixed to the other side of the leaf spring 83 by rivets or the like. The leaf spring 83 presses against the armature 76 in the direction indicated by D in FIG. 11 against the motor gear 78 to render it immovable under engine vibration conditions.

The armature 76 rotates together with the motor gear 76. A clutch coil 82 is fixed to a resinous throttle cover 172 and disposed to be coaxial with the hub 75. The coil 82 forms a electromagnetic clutch with the armature, the hub 75 and the leaf spring 83. Thus, heat generated in the energized clutch coil 82 is prevented from being transmitted to the bearing 62 through throttle cover 172 and the motor shaft 80*b* and deterioration of grease in the bearings is prevented. Of course, the throttle cover may be replaced by aluminum or iron plate.

When the clutch coil 82 is energized, the armature 76 is attracted to the hub 75 against the spring force of the leaf spring 83 and engages with the hub 75 firmly to rotate therewith. The motor gear 78 rotates together with the armature 75, and the driving force is transmitted from the motor gear 78 to a connecting gear 86 and the control gear 33. Since the electromagnetic clutch consisting of the hub 75, the armature 76, the clutch coil 82 and the leaf spring 83 is disposed coaxially with the motor shaft 80*b* of the motor 60, the size of the electromagnetic clutch is reduced.

Figure 12:
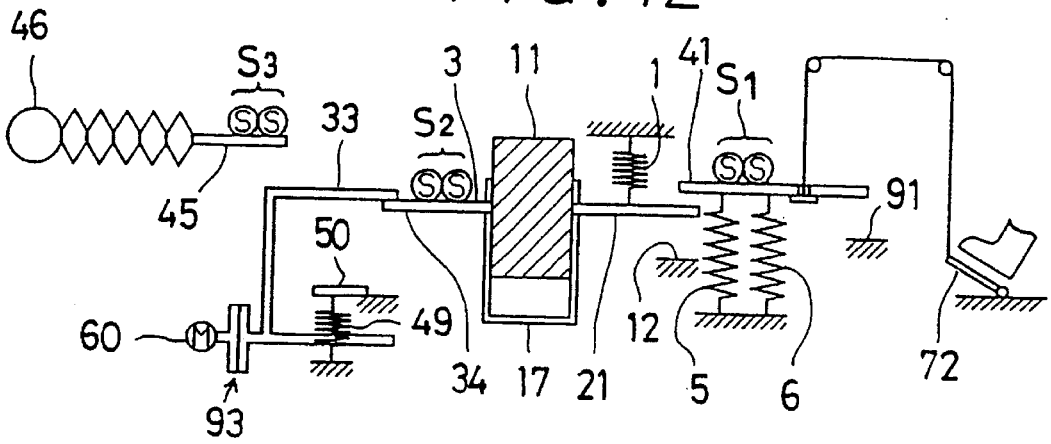
FIG. 12 is a schematic illustration of the operation of a throttle valve control device according to a fifth embodiment of the present invention.

A throttle valve control device according to a fifth embodiment of the present invention is described below with reference to FIG. 12.

In this embodiment, a spring corresponding to the spring 2 of the first embodiment is omitted in this embodiment. The fail-safe control as described in the first embodiment is implemented by an electronic control system, and more down-sizing of the device is therefore possible.

Figure 13:
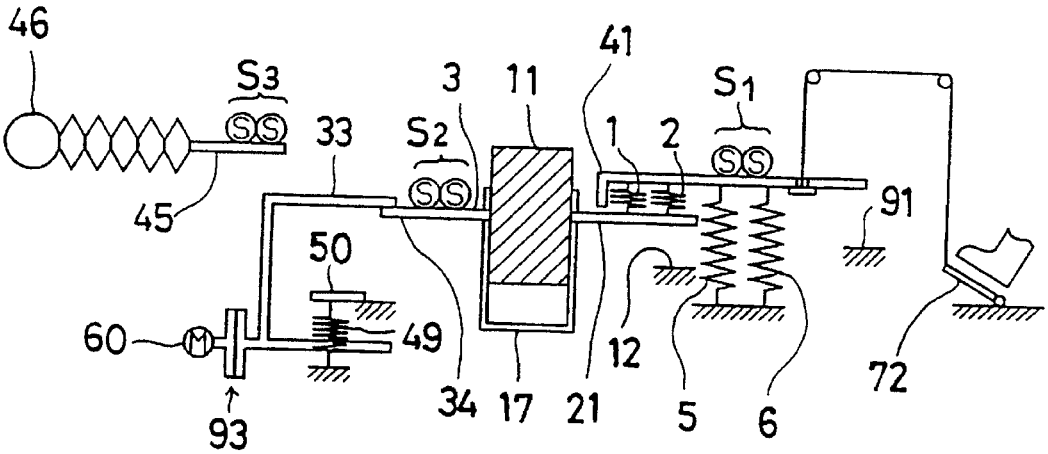
FIG. 13 is a schematic illustration of the operation of a throttle valve control device according to a sixth embodiment of the present invention.

A throttle valve control device according to a sixth embodiment of the present invention is described below with reference to FIG. 13.

In this embodiment, one end of each of springs corresponding to the springs 1 and 2 of the first embodiment is fixed to an accelerator upper limit guard 41 instead of the throttle body 17 as in the first embodiment. If the electric control system fails, when the driver releases the accelerator pedal and the upper limit guard 41 abuts a throttle lever 21, the throttle valve 11 is not biased to open further. As a result, the size of springs 5 and 6 may be reduced and the accelerator pedal may be controlled more lightly.

Figure 14:
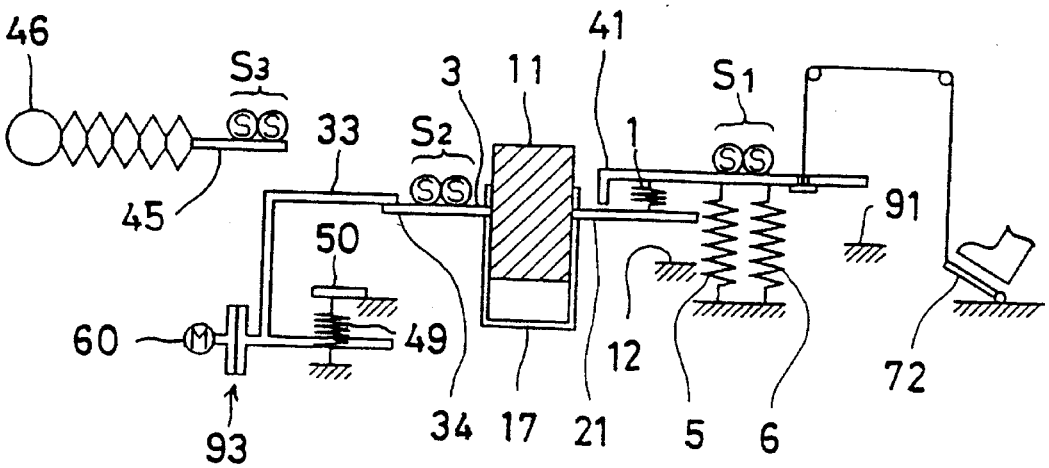
FIG. 14 is a schematic illustration of the operation of a throttle valve control device according to a seventh embodiment of the present invention.

A throttle valve control device according to a seventh embodiment of the present invention is described below with reference to FIG. 14.

A spring corresponding to the spring 2 of the sixth embodiment is omitted in this embodiment. Since the spring is omitted, the size of the device is reduced. In case the spring 1 of this embodiment breaks, the throttle valve control in the ordinary operation of the engine may be continued by an electric control system as described above.

Figure 15:
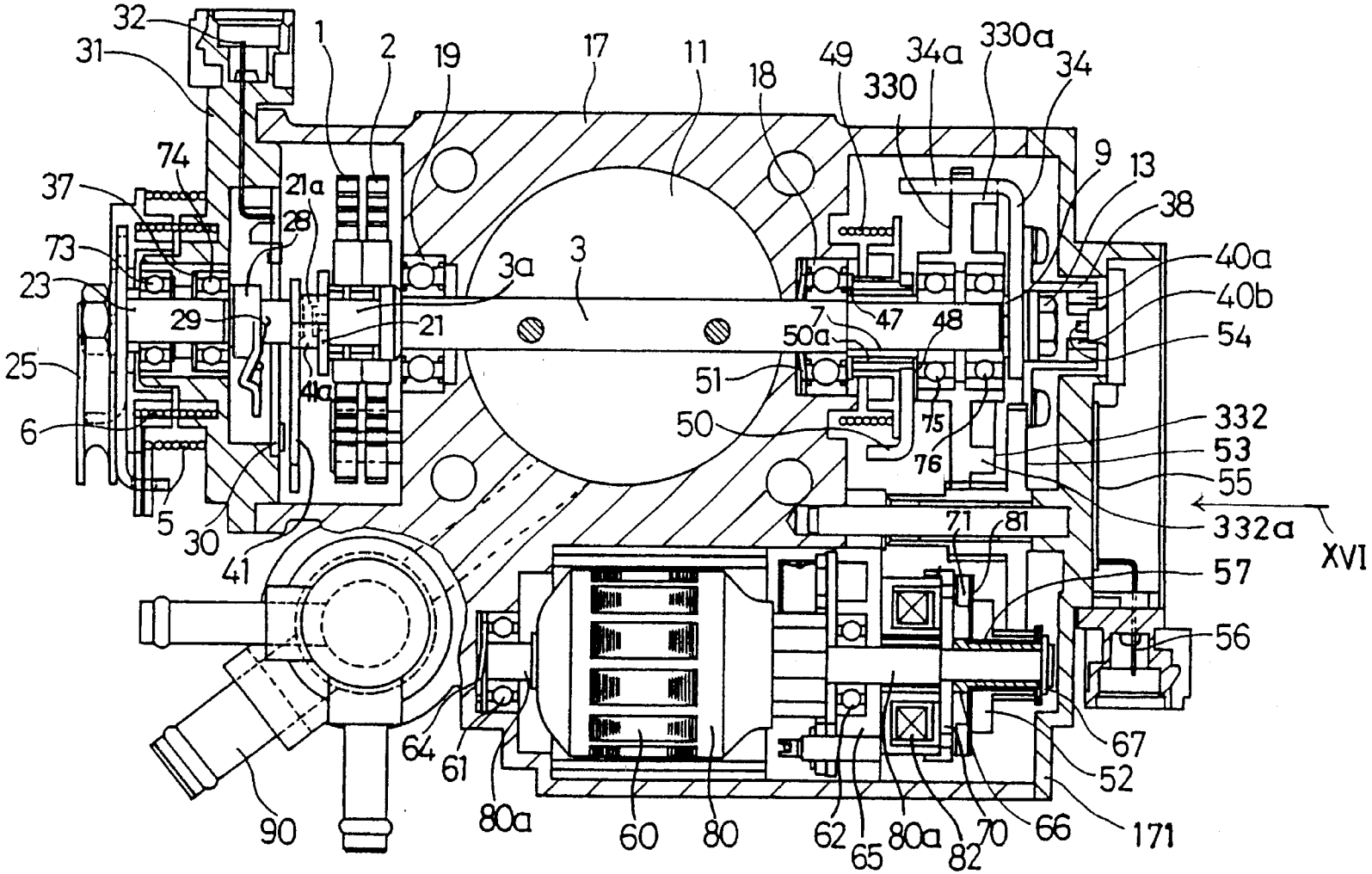
FIG. 15 is a cross-sectional side view illustrating a throttle valve control device according to an eighth embodiment of the present invention.
Figure 16:
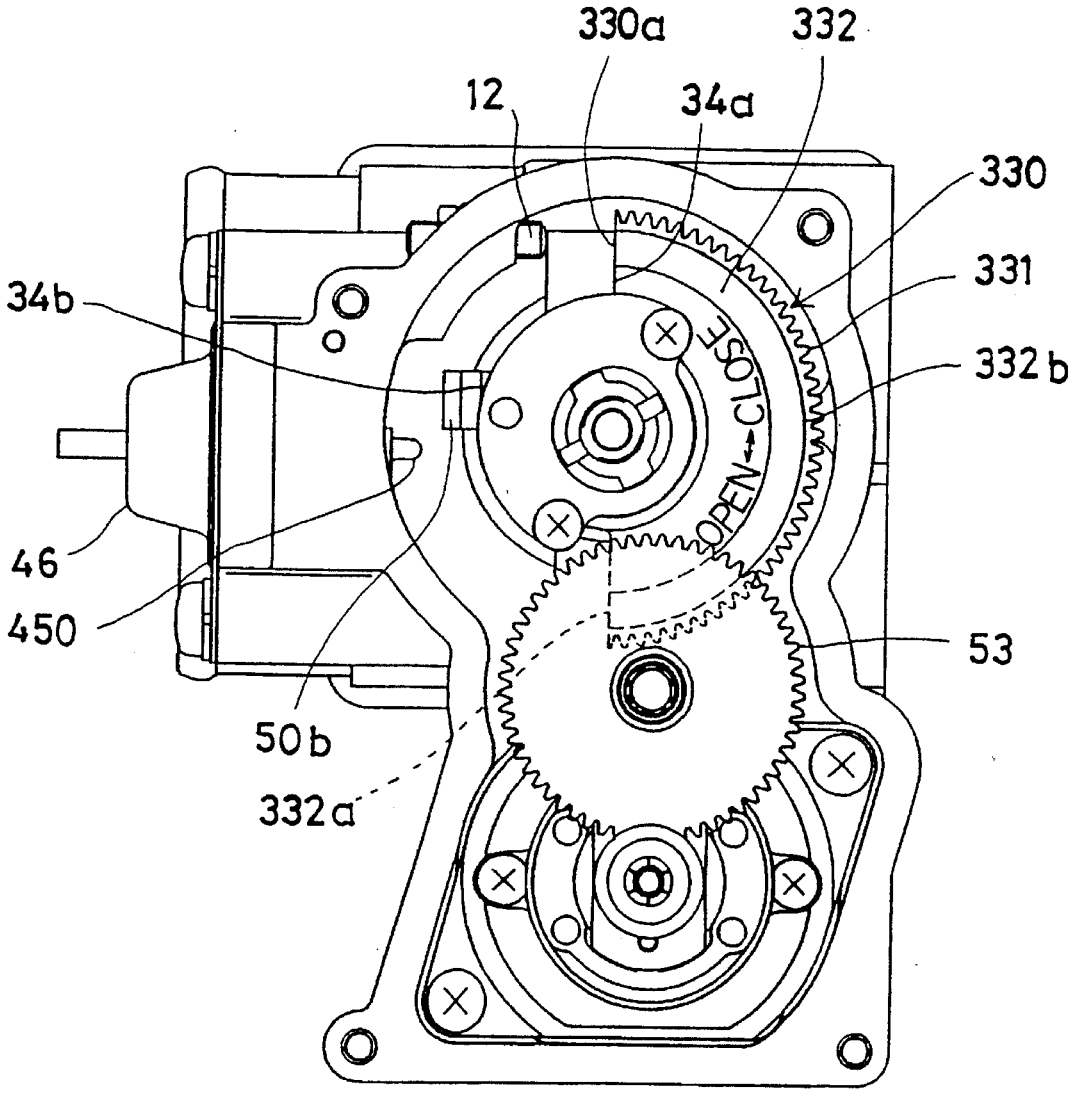
FIG. 16 is a cross-sectional front view of the device illustrated in FIG. 15 viewed from a portion indicated by an arrow XVI.
Figure 17:
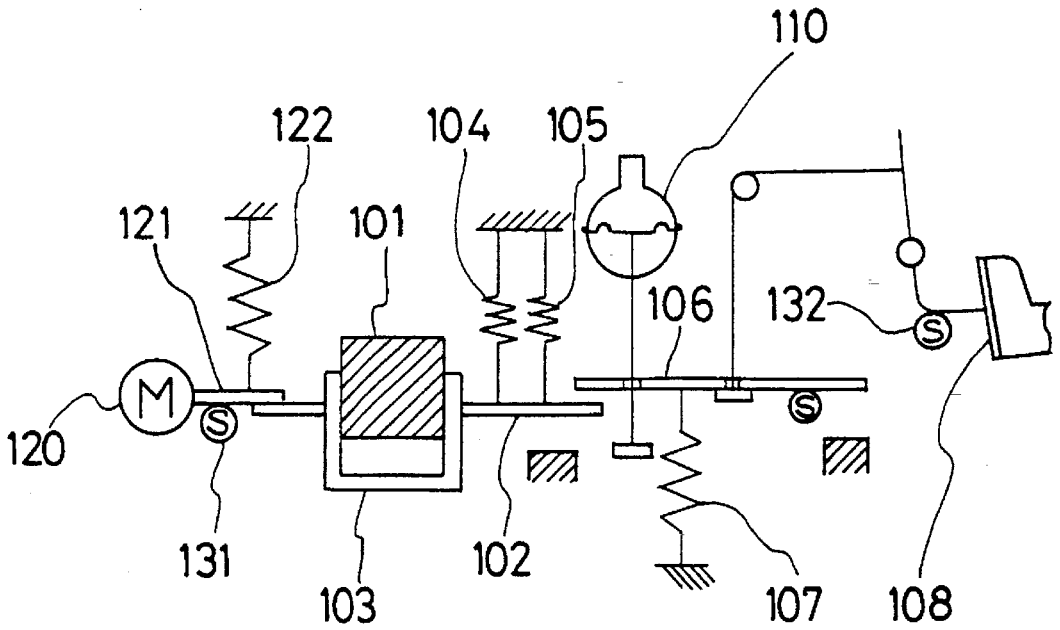
FIG. 17 PRIOR ART
FIG. 17 is a schematic illustration of the operation of a conventional throttle valve control device during the normal operation.
Figure 18:
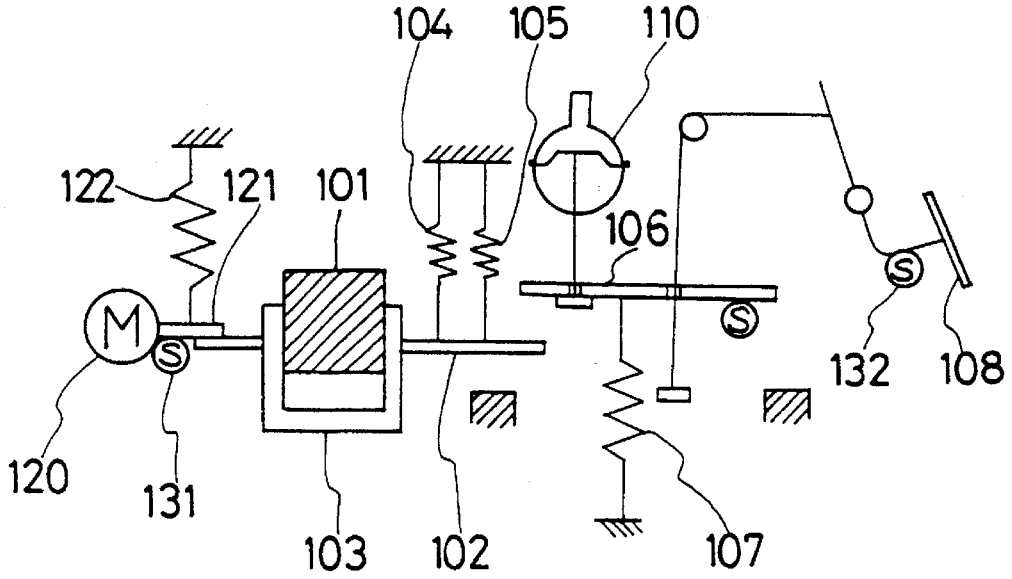
FIG. 18 PRIOR ART
FIG. 18 is a schematic illustration of the operation of the conventional device during cruise control of a vehicle.

A throttle valve control device according to a eighth embodiment of the present invention is described below with reference to FIGS. 15 and 16.

In this embodiment, a semi circular control gear 330 has a gear contact portion 330*a* on its side facing the valve closing direction and teeth 331 on its outer periphery formed integrally therewith. An annular cam portion 332 is formed on a portion radially inside the teeth 331. The cam portion 332 has a contact portion 332*a* at one end. A safety stopper 450 having a round head is disposed in a portion of the throttle body so that the contact portion 332*a* can abut the safety stopper 450, however, the teeth 331 cannot abut the stopper 450. When the control gear 330 turns counterclockwise in FIG. 16, that is, in the valve closing direction, the gear contact portion 330*a* abuts a lever contact portion 34*a* of the connecting lever 34, which closes the throttle valve 11. When the control gear 330 turns in the valve opening direction (clockwise), the gear contact portion 332*a* of the cam 332 abuts the safety stopper 450, and the control gear 330 is prevented from further turning in the valve opening direction. As a result, the control gear is only allowed to turn to the valve closing direction at this stage.

During the cruise control, since the safety stopper 450 is retracted by a vacuum actuator as described before, the gear contact portion 332*a* turns beyond the portion where the safety stopper 450 otherwise existed. In case the vacuum actuator fails by accident and the safety stopper jumps out toward the control gear 330, the stopper abuts the outer surface of the cam portion 332 instead of the teeth 331, so that the throttle valve control is not locked up by engaging the safety stopper 450 with the teeth 331. Since the safety stopper 450 has a round head, the frictional force is reduced during the abutment of the safety stopper 450 with the surface of the cam portion 332. However, a roller may be provided instead of the round head on the safety stopper 450. The hub 70, the collar 66 and a spacer 67 are secured to the motor shaft of the motor 60 by squeezing the end of the motor shaft in this embodiment. However, they may be secured by a snap washer and a nut structure.

The driving force of the motor 60 may be transmitted to the throttle shaft by a belt and pulley mechanism instead of the gear mechanism used in this embodiment.

The control gear in this embodiment has a half circular gear plate. However, a ¼, ⅓, ⅔, or ¾ circular gear plate may be also used. A ring-shaped or U-shaped member may be arranged to control the throttle valve for the control gear of this embodiment.

In the foregoing discussion, the invention has been described with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than a restrictive, sense.

What is claimed is:

1. A throttle valve control device including a throttle valve for supplying controlled air to an engine, said device comprising:

a housing for said throttle valve;

a lever member connected to said throttle valve for driving said throttle valve;

a first spring member secured to said housing and connected to said lever member or biasing said throttle valve in a direction to open said throttle valve;

a guard member engageable with said lever member in response to an accelerator pedal operation for limiting said lever member to open said throttle valve within a set angle;

a second spring member for biasing said guard member in a direction to close said throttle valve where a biasing force of said second spring member is greater than a biasing force of said first spring member;

an electric motor unit disposed in said housing for controllably generating a driving force; and throttle valve control means, disposed coaxially with said motor unit between said throttle valve and said motor unit, for transmitting the driving force from said motor unit to said throttle valve, said valve control means opening said throttle valve and said guard member against the biasing force of said second spring member.

2. A throttle valve control device according to claim 1, wherein said throttle valve control means comprises:

an additional lever member; and a control member connected to said motor unit, said control member having a contact member engaging with said additional lever member to open said throttle valve against said second spring member.

3. A throttle valve control device according to claim 2, wherein said control member comprises another contact member engaging with said additional lever member to close said throttle valve.

4. A throttle valve control device according to claim 3, wherein said control member comprises a U-shaped member having contact members engaging with said additional lever member to open and close said throttle valve.

5. A throttle valve control device according to claim 2, further comprising:

a lock for limiting further movement of said control member, and an actuator for operating said lock.

6. A throttle valve control device according to claim 1, wherein said throttle valve control means comprises an electromagnetic clutch, disposed coaxially with said motor unit, for selectively connecting and disconnecting said motor unit and said throttle valve.

7. A throttle valve control device according to claim 6, wherein said electromagnetic clutch comprises:

a clutch rotor secured to said motor unit;

an armature disposed coaxially with said motor unit and engageable with said clutch rotor;

a third spring member biasing said armature to separate said armature from said clutch rotor;

a clutch coil for generating magnetic force to engage said clutch rotor and said clutch coil to said armature against said third spring member, and a speed reduction gear unit, secured to said armature, having a gear which is smaller in diameter than said armature, for increasing a driving force of said motor unit and for transmitting said increased driving force to said throttle valve.

8. A throttle valve control device including a throttle valve for supplying controlled air to an engine suction pipe, a motor having a shaft for driving said throttle valve, an electromagnetic clutch disposed coaxially with said shaft and driving force transmitting unit having a speed reduction mechanism for transmitting a driving force from said motor, wherein:

said driving force transmitting unit comprises a driving force transmitting member rotatably carried by said shaft; and said electromagnetic clutch comprises a clutch rotor secured to said shaft, an armature rotatably carried by said shaft and having a contact member engageable with said clutch rotor, said contact member being greater in diameter than an outer periphery of said driving force transmitting member;

a biasing member, secured to said unit, for biasing said armature to separate said armature from said clutch rotor; and a clutch coil for generating magnetic force when energized to engage said armature with said clutch rotor against said biasing member.

9. A throttle valve control device including a throttle valve for supplying controlled air to an engine, said device comprising:

a housing for said throttle valve;

a first lever member connected to said throttle valve for biasing said throttle valve in a direction to open said valve;

a guard member, biased in the direction to open said throttle valve and engageable with said first lever member in response to an accelerator pedal operation, for limiting said first lever member to open said throttle valve within a set range;

an electric motor unit disposed in said housing for generating a driving force; and throttle valve control means, having a speed reduction mechanism, an electromagnetic clutch and a second lever member connected to said throttle valve, for controllably driving said throttle valve through said second lever member under a driving force which is greater than the driving force generated by said motor unit and biasing force of said guard member.

10. A throttle valve control device according to claim 9, wherein said control means comprises a U-shaped member engageable with said second lever member when said throttle valve control means opens or closes said throttle valve.

11. A throttle valve control device according to claim 10, further comprising:

a lock for limiting further movement of an output gear member in said throttle valve control means, and an actuator for operating said lock.

12. A throttle valve control device including a throttle valve for supplying controlled air to an engine, said device comprising:

a housing for said throttle valve;

a first lever member connected to said throttle valve for biasing said throttle valve in a direction to open said valve;

a second lever member connected to said throttle valve:

a guard member engageable with said first lever member for biasing said first lever member to limit further opening of said throttle valve;

an electric driving unit disposed in said housing, said unit having a motor, an electromagnetic clutch disposed coaxially with said motor and a speed reduction mechanism connected to said clutch, for generating a driving force which is greater than a biasing force of said guard member; and a throttle valve control member connected to said speed reduction mechanism for engaging with said second lever member when said control member opens and closes said throttle valve.

13. A throttle valve control device according to claim 12, wherein said throttle valve control member comprises a U-shaped member engageable with said throttle valve when said throttle valve control member opens and closes said throttle valve.

14. A throttle valve control device according to claim 12, further comprising:

a lock for limiting further movement of an output gear member in said throttle valve control member, and an actuator for operating said lock.

15. A throttle valve control device including a housing, a throttle valve, a first throttle valve operating system and a second throttle valve operating system, wherein said first throttle valve operating system comprises:

an accelerator pedal, a first lever member connected to said throttle valve for biasing said throttle valve to open, and a guard member, biased in a direction to open said throttle valve against said first lever member and disposed to engage said first lever member in response to said accelerator pedal, for limiting said first lever member to open said throttle valve within a set value;

and, wherein said second throttle valve operating system comprises:

a second lever member connected to said throttle valve, an electric motor unit disposed in said housing for generating a driving force;

an electromagnetic clutch connected to said motor unit for controllably transmitting said driving force, a speed reduction unit connected to said electromagnetic clutch for increasing the driving force from said motor unit so that it is greater than a biasing force of said guard member, and a control member connected to said speed reduction unit for engaging said second lever member when said second system opens and closes said throttle valve.

16. A throttle valve control device according to claim 15, wherein said control member comprises a U-shaped member engageable with said throttle valve when said second throttle valve operating system opens or closes said throttle valve.

17. A throttle valve control device according to claim 16, further comprising: a lock for limiting further movement of an output gear member in said throttle valve control member, and an actuator for operating said lock.

* * * * *